US007908795B2

(12) United States Patent
Arimoto

(10) Patent No.: US 7,908,795 B2
(45) Date of Patent: Mar. 22, 2011

(54) WINDOW CARRIER ASSEMBLY FOR AUTOMOTIVE WINDOW REGULATOR

(75) Inventor: Shigeki Arimoto, Bloomfield, MI (US)

(73) Assignee: Hi-Lex Controls Inc., Rochester Hills, MI (US)

( * ) Notice: Subject to any disclaimer, the term of this patent is extended or adjusted under 35 U.S.C. 154(b) by 561 days.

(21) Appl. No.: 11/728,618

(22) Filed: Mar. 27, 2007

(65) Prior Publication Data

US 2008/0236049 A1 Oct. 2, 2008

(51) Int. Cl.
*E05F 11/48* (2006.01)

(52) U.S. Cl. ..... 49/375; 49/352; 49/374

(58) Field of Classification Search ..... 49/348, 49/349, 352, 372, 374, 375
See application file for complete search history.

(56) References Cited

U.S. PATENT DOCUMENTS

| | | | | |
|---|---|---|---|---|
| 5,809,695 | A * | 9/1998 | Strickland | 49/352 |
| 5,864,987 | A * | 2/1999 | Mariel et al. | 49/352 |
| 6,233,873 | B1 * | 5/2001 | Lawrie et al. | 49/375 |
| 2004/0107645 | A1 * | 6/2004 | Galliani | 49/375 |
| 2007/0000178 | A1 * | 1/2007 | Wild et al. | 49/352 |
| 2007/0180773 | A1 * | 8/2007 | Fortin et al. | 49/352 |
| 2008/0005971 | A1 * | 1/2008 | Dickie et al. | 49/349 |

* cited by examiner

*Primary Examiner* — Gregory J. Strimbu
(74) *Attorney, Agent, or Firm* — Brinks Hofer Gilson & Lione

(57) ABSTRACT

A window carrier assembly for an automotive window regulator. The carrier assembly is a composite assembly of a center body section preferably formed of injection molded plastic material and a pair of window clamps that are snap assembled to the carrier body section. The window regulator assembly preferably is used in connection with a single rail-type window regulator. The body section of the carrier assembly features a cable end receiving socket which allows both ends of the drive cable to be installed in a manner which can be done rapidly in component assembly.

13 Claims, 10 Drawing Sheets

WINDOW CARRIER ASSEMBLY FOR AUTOMOTIVE WINDOW REGULATOR

FIELD OF THE INVENTION

This invention relates to a component for automobiles and particularly to a window clamp assembly used as part of an automotive movable window regulator assembly.

BACKGROUND AND SUMMARY OF THE INVENTION

Motor vehicles have for many decades featured movable side door glass. A mechanism is required in order to move the glass between the upper closed position and the lower opened position. These mechanisms are generally known as window regulators. Window regulators can be manually operated by an operator, or can be driven by a powered actuator, most commonly an electric motor. One type of window regulator uses a pulley arrangement using a metal cable wrapped around a drum driven by an electric motor. This device uses a carrier which engages the door glass and fastens it to the window regulator assembly to control its motion as it moves vertically.

Window regulator mechanisms can still be categorized into a group which includes dual rail and single rail types. In a dual rail system, a pair of separated rails are provided which each include a movable window clamp which is fastened to the lower edge of the glass and move in a synchronized manner to raise and lower the glass. In a single rail type, a single rail is positioned at near the center of the window glass and includes a clamp assembly which engages the lower edge of the window. The clamp assembly moves vertically along the rail between the open and closed positions. A single rail type provides a window regulator assembly with fewer parts than a dual rail system, but poses design challenges in providing sufficient stability for the control of the glass motion since it is controlled by a single rail and window clamp assembly.

Designers and manufacturers of automotive components are continuously striving to reduce their cost, complexity, and weight in order to provide features and functions for motor vehicles at minimum cost. In one type of existing single rail window regulator, a window clamp assembly is provided made from a large stamping of sheet metal. The sheet metal parts are formed to span across the rail to engage the rail and further includes provisions for mounting a pair of separated clamps which fasten to the lower edge of the glass. The large sheet metal stamping requires a significant capital investment for its production because of its size, and further is a relatively heavy and expensive component to fabricate. One feature of the present invention is to provide an improved carrier assembly for a window regulator which can be formed of injection molded plastic materials with components added to them in a manner which provides a cost effective and functional clamp assembly.

For most window regulators of the above-mentioned cable pulley type, it is necessary to terminate the drive cable within at the carrier assembly. Various techniques for cable termination are known. It is another feature of the present invention to provide a cable termination system which provides manufacturing simplicity while meeting performance requirements for such termination.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
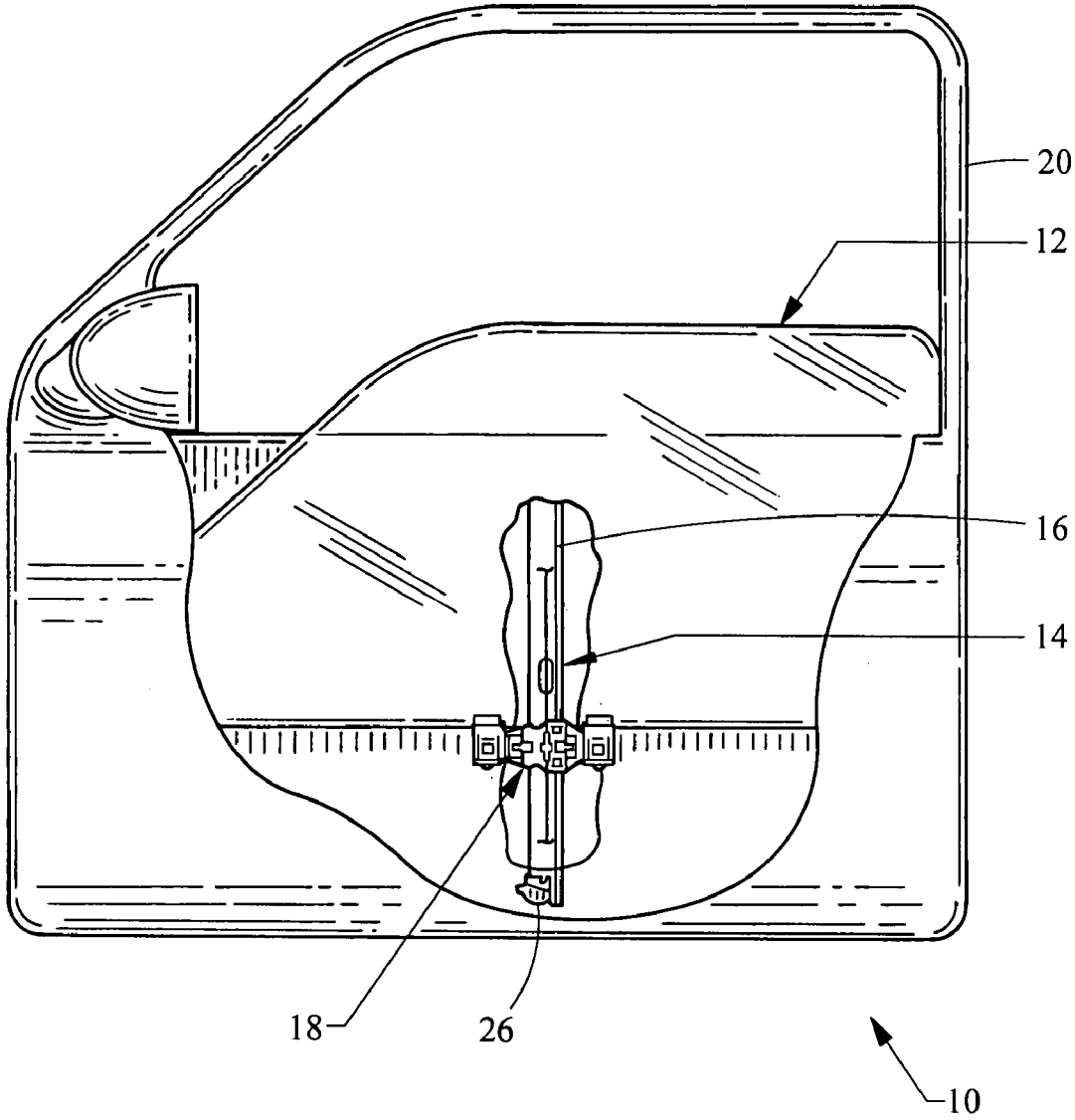
FIG. 1 is a side cut-away view of a motor vehicle door assembly showing movable door glass and portions of a window regulator assembly including features according to this invention.

FIG. 1 is a side view of an automotive door 10 shown cut-away revealing the side movable door window 12 and a portion of window regulator assembly 14. Door window 12 can be formed of glass or other glazing materials such as polycarbonate. The portions of window regulator assembly 14 shown in FIG. 1 include guide channel 16 and window carrier assembly 18. Not illustrated in FIG. 1 are additional components of window regulator assembly 14 necessary to make it fully functional, including a drive motor and other related components. These additional components are well known and are not principal elements of this invention. FIG. 1 illustrates the door window 12 in an intermediate position between its lowered-opened and raised-closed positions. This motion is guided by a pair of side glass run channels (not shown) along glass frame 20. In the fully raised-closed position of window 12, it is sealed within glass frame 20.

Figure 2:
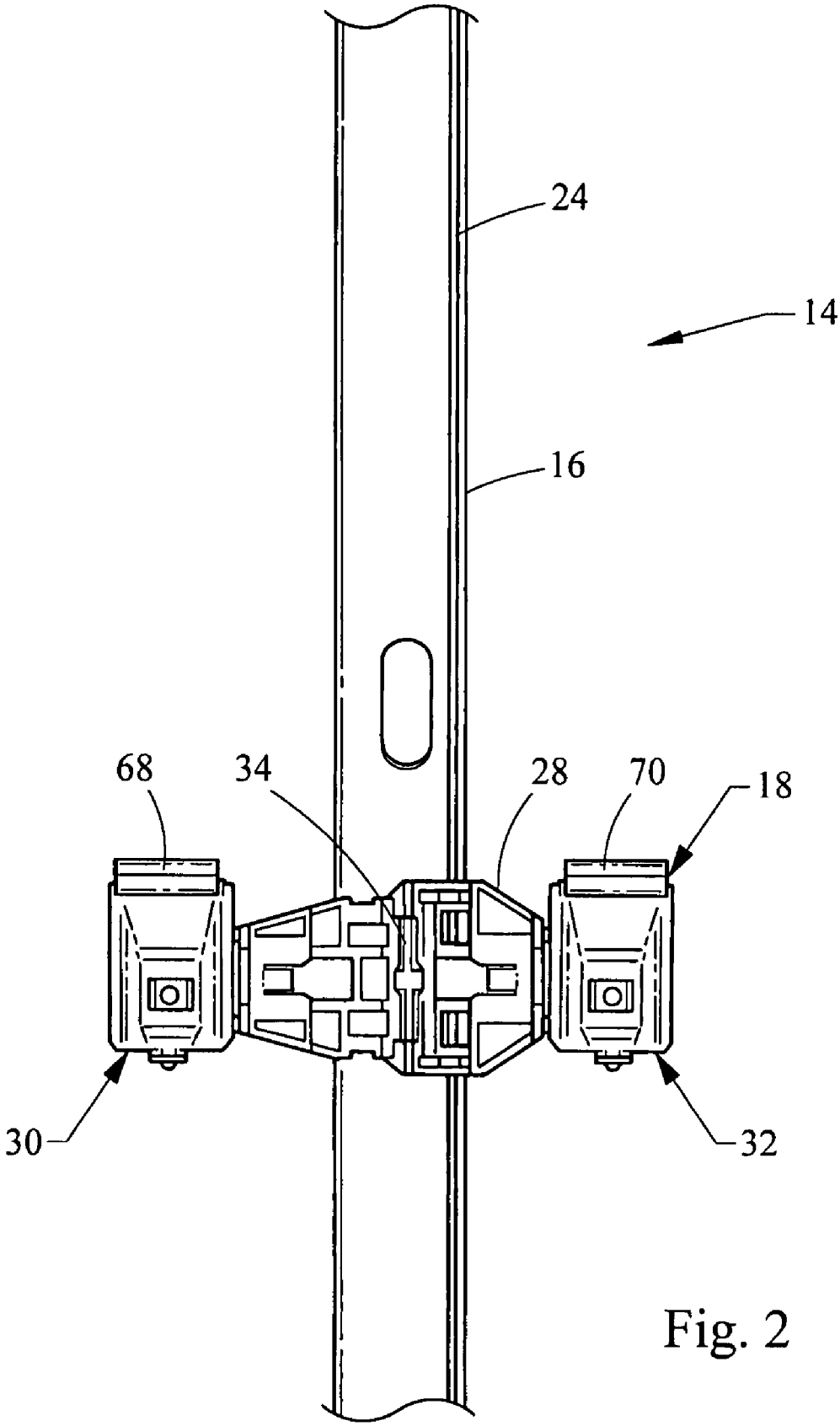
FIG. 2 is an illustration of portions of a window regulator assembly including a carrier assembly in accordance with this invention.

Now with reference to FIG. 2, greater details of components of window regulator assembly 14 are shown. Guide channel 16 is preferably formed of sheet metal and includes a return bent flange 24. Cable pulley 26 is used to guide a drive cable, which will be described in greater detail in the description below. Guide channel 16 acts as a rail allowing carrier assembly 18 to move along its length.

Carrier assembly 18 is generally comprised of a center body 28 and a pair of window clamps 30 and 32 affixed to the body. Now with reference to FIG. 3, additional features of carrier assembly 18 will be described. Carrier assembly body 28 is preferably formed from an injection molded polymeric material which can be cost-effectively produced. Body 28 includes cable attachment pocket 34 and further forms a pair of laterally opening clamp mounting slots 36 and 38. Slots 36 and 38 are laterally extended longitudinal opening slots. Body 28 integrally forms a pair of tabs 40 and 42 which are attached to the remainder of body 28 along their side edges 44 and 46 such that the tabs 40 and 42 are cantilever supported. Side edges 44 and 46 enable tabs 40 and 42 to be flexed out of position from intersecting with slots 36 and 38, and provide the function of snap engagement with window clamps 30 and 32, as will be described in more detail below. Body 28 further forms a vertically extending channel 48 best shown by FIG. 4 and arms 49 and 51 which wrap over the side edges of the guide channel. These features closely receive guide channel 16 interlocking body 28 with the guide channel enabling the body to slide vertically along the guide channel. FIGS. 2 and 4 show carrier assembly 18 mounted in position on guide channel 16 to move vertically in this manner.

Figure 3:
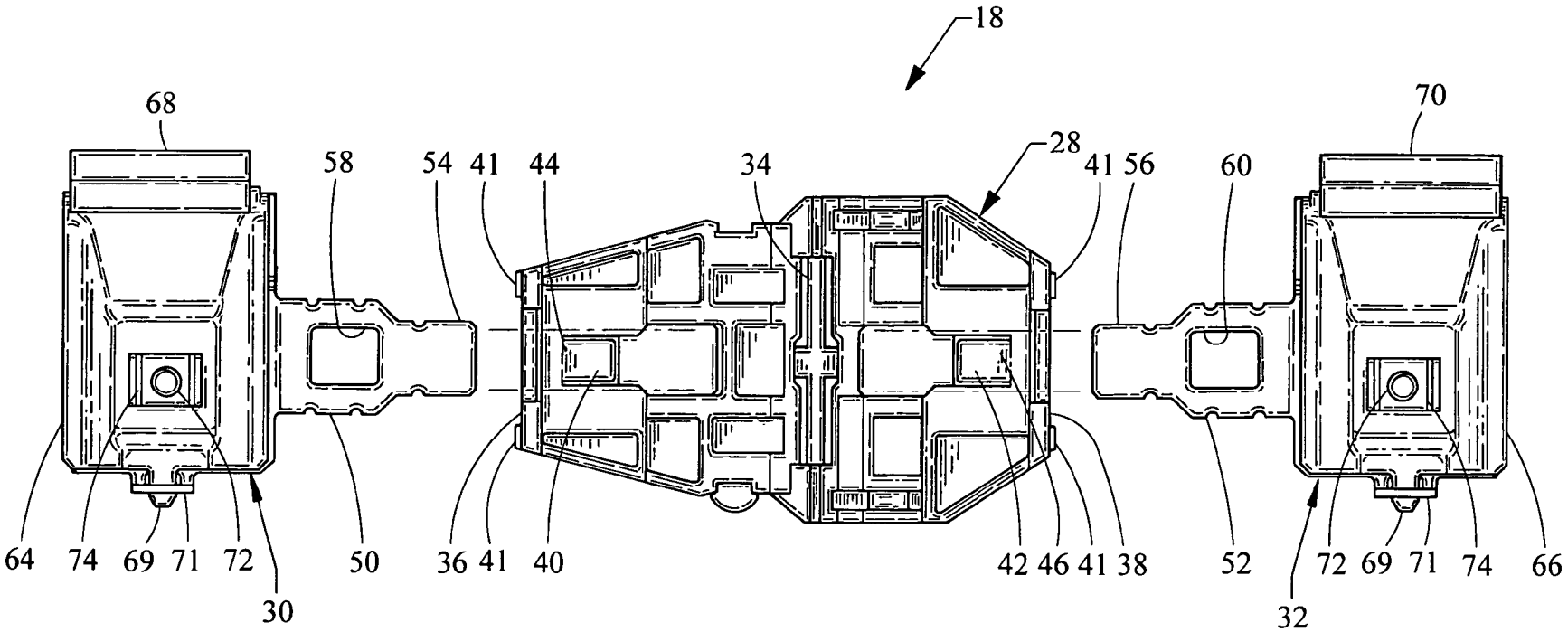
FIG. 3 is an exploded view of the window carrier assembly of the present invention.
Figure 4:
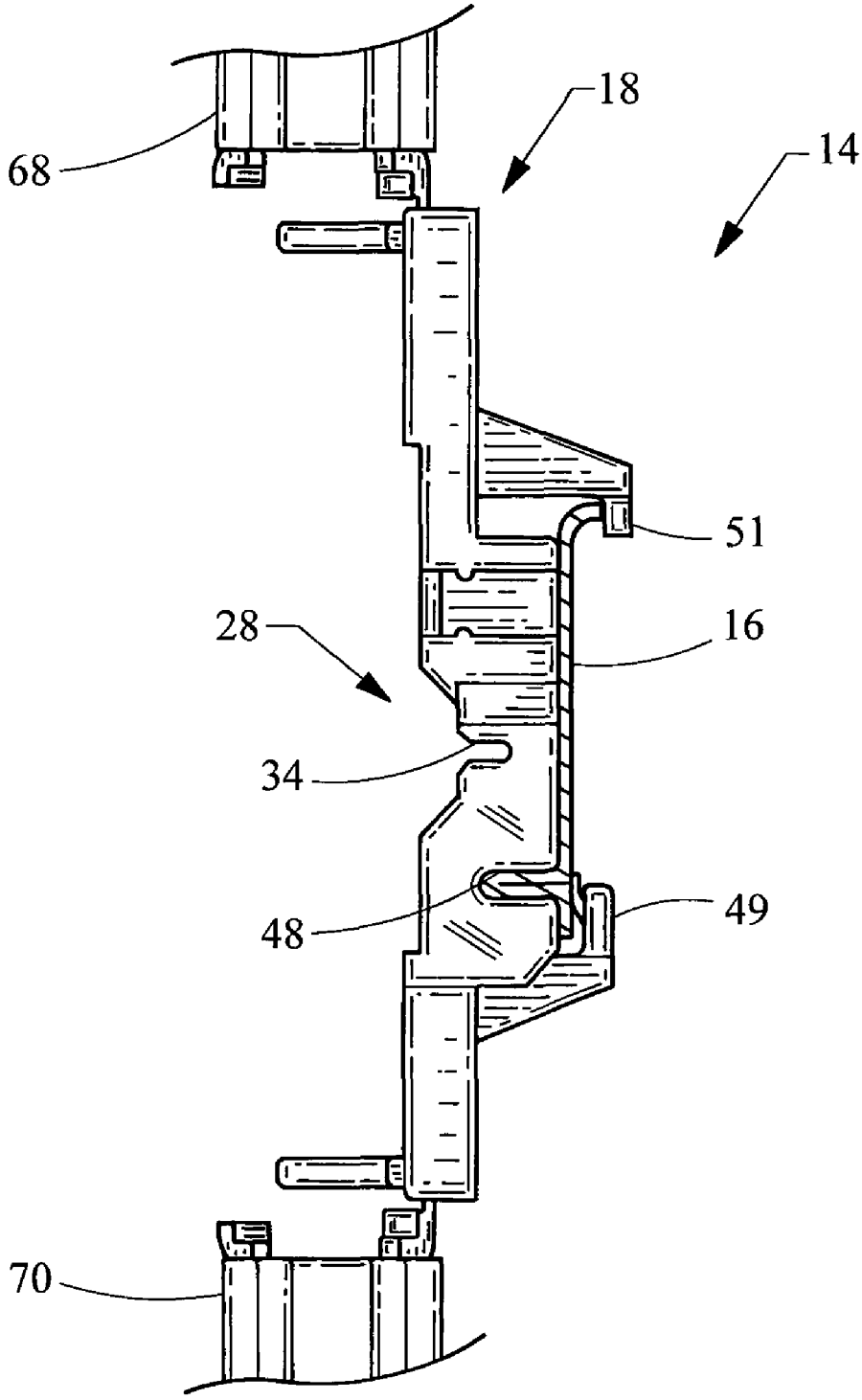
FIG. 4 is a cross-sectional view taken through the carrier assembly engaged with the guide channel.

Each of clamps 30 and 32 as shown in FIG. 3, include bottom plates 50 and 52, preferably formed of sheet metal, each having extending attachment ears 54 and 56, each with apertures 58 and 60, respectively. Clamps 30 and 32 further have additional clamp top plates 64 and 66 which cooperate with plates 50 and 52 to form a clamp to pinch together and engage the lower edge of door window 12. Window jaws 68 and 70, preferably formed from an elastomer, are positioned between the clamp plates to securely clamp window 12 when threaded fasteners 72 are tightened which are threaded into press nuts 74. The respective clamp plates inter-engage one another at the lower edge of inter-fitting tabs 69 and slots 71 as shown in FIG. 3.

During assembly, attachment clamps 30 and 32 are assembled with body 28 by sliding attachment ears 54 and 56 into respective body slots 36 and 38. During this assembly process, ears 54 and 56 are pressed into position and this motion causes tabs 40 and 42 to be deflected out of intersection with the slots 36 and 38 until the clamp ears are in their final position at which time the tabs can deflect into interlocking engagement with apertures 58 and 60. The fully assembled positions of the clamps 30 and 32 are shown in FIG. 4. To enable such "snap-attachment" assembly, the tabs 40 and 42 have a chamfered leading edge which engages ears 54 and 56, to deflect them out of position. At each of the lateral sides of carrier body 28 projection short posts 41 are formed. Posts 41 are positioned adjacent to the upper edge of clamp mounting slots 36 and 38. When window clamps 30 and 32 are assembled with carrier body 28, the posts 41 abut against the clamps to help stabilize the clamps, limiting their rotational displacement within slots 36 and 38.

The above-described configuration for carrier assembly 18 provides a cost effective automotive component which reduces fabrication cost by minimizing the size of the stamped sheet metal components which in this case are confined to clamps 30 and 32. Moreover, this provides a modular construction approach enabling the clamps 30 and 32 to also be used for other design systems such as dual rail window regulator assemblies.

Figure 5:
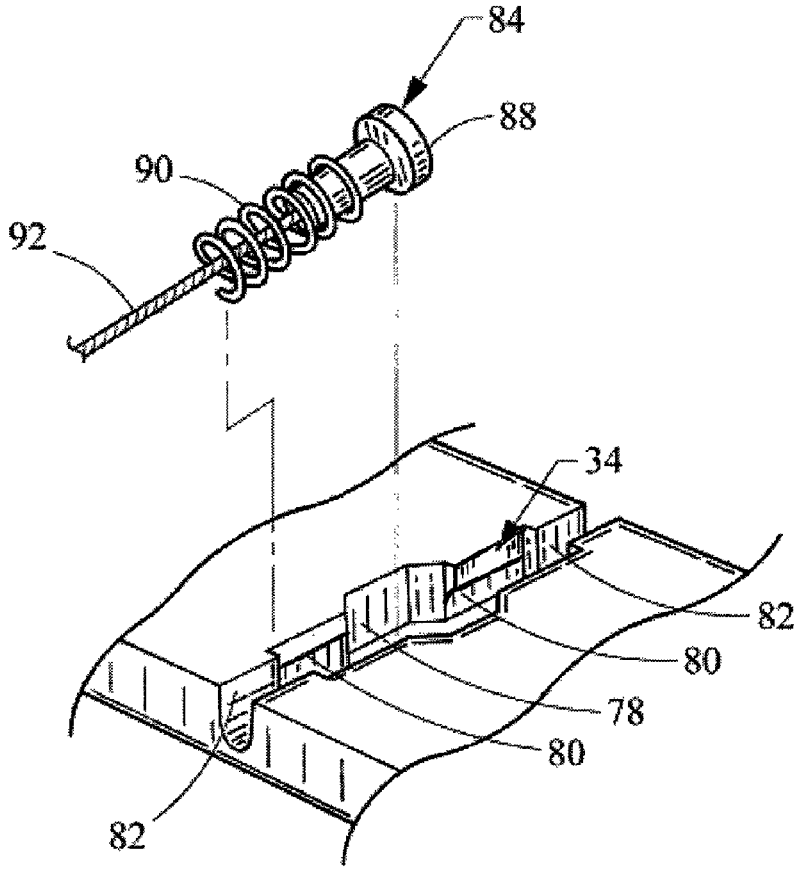
FIG. 5 is a pictorial view showing the cable termination pocket with a cable end shown before being inserted into position within the pocket.
Figure 6:
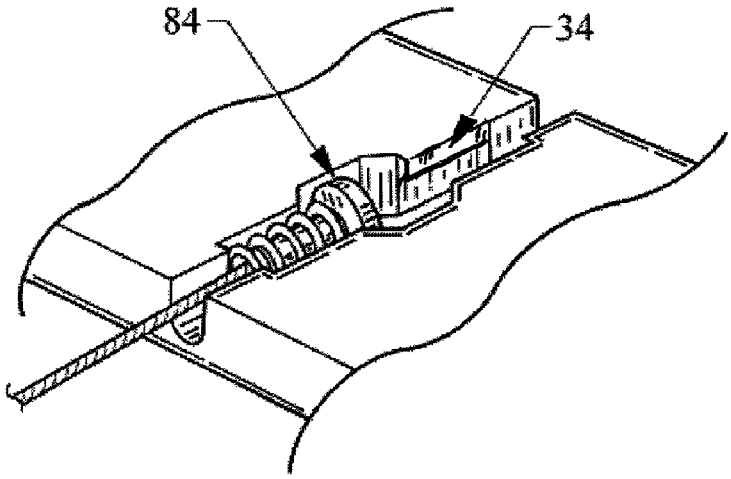
FIG. 6 is a view figure similar to FIG. 5 showing one of the cable ends in an inserted position within the cable pocket.
Figure 7:
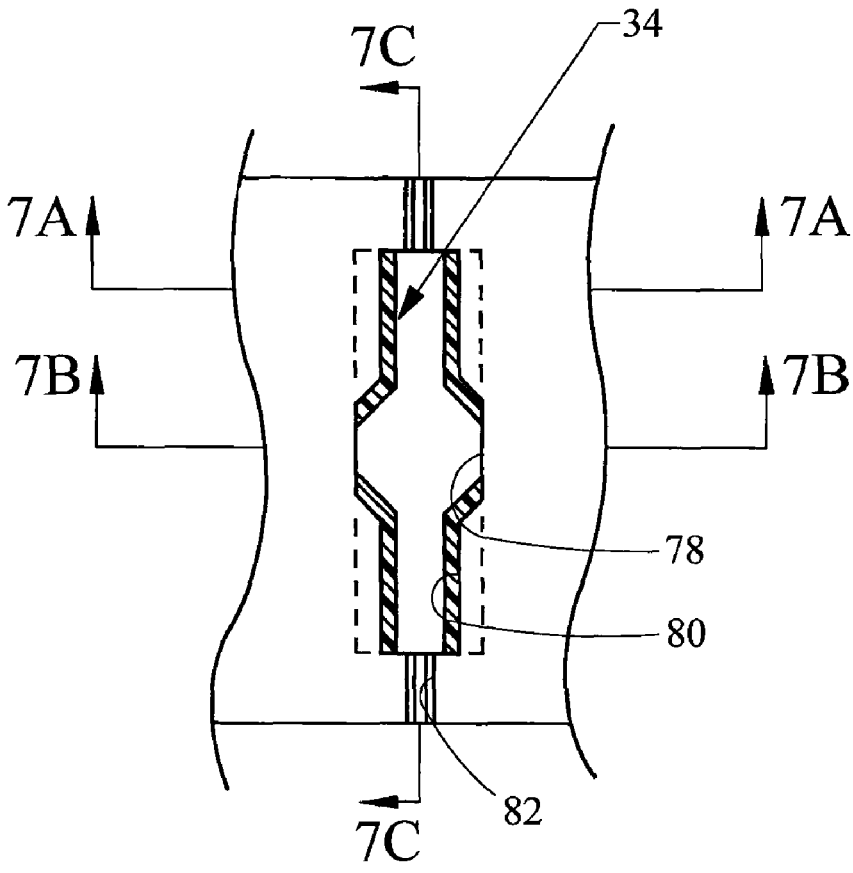
FIG. 7 is a cross-sectional view of the cable pocket.
Figure 7A:
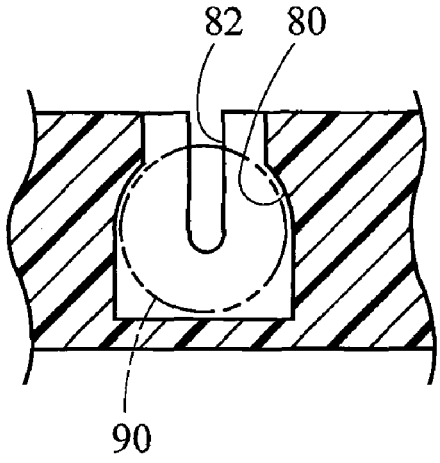
FIG. 7A is a cross-sectional view taken along line 7A-7A from FIG. 7.
Figure 7B:
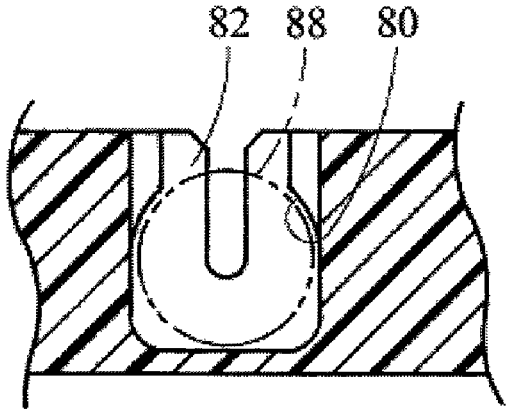
FIG. 7B is a cross-sectional view taken along line 7B-7B from FIG. 7.
Figure 7C:
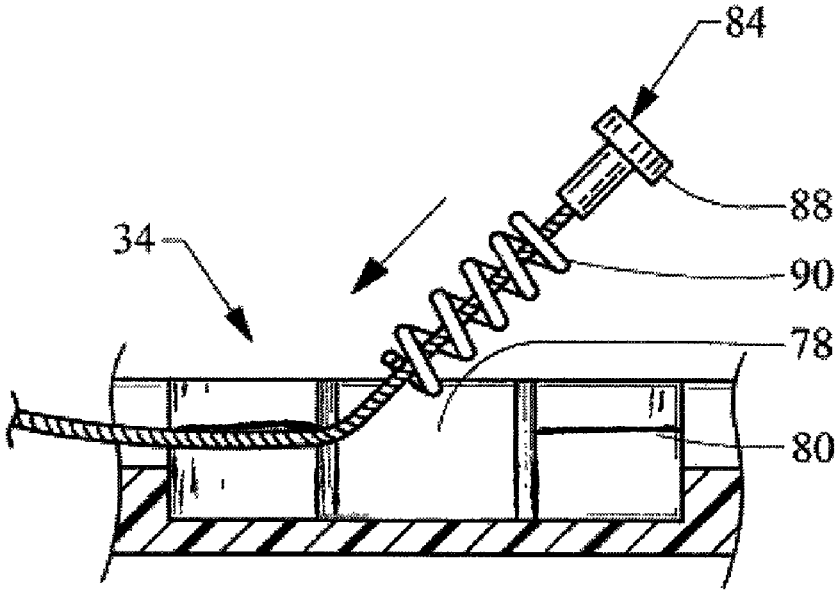
FIG. 7C is a side sectional view showing the installation of a cable end into the cable pocket.

Now with reference to FIGS. 5 through 8, details of cable pocket 34 are provided. As illustrated in FIG. 5, cable pocket 34 includes a center wide section 78, narrowed intermediate sections 80 and each terminate laterally in narrow cable passages 82. The cross-sectional width of the section decrease from center section 78 to intermediate section 80 to cable passage 82. Each of cable ends 84 and 86 include an end button 88 attached to the end of the cable with a coil spring 90 surrounding the cable and abutting against button 88. Cable socket center section 78 is large enough to accommodate button 88 whereas intermediate section 80 has a slightly rounded shape in cross-section and cable passage 82 is sufficiently narrow to allow cable 92 to pass but not large enough to allow coil spring 90 to be pulled through the passage. FIG. 7A shows the configuration of cable passage 82 which forms a narrow slot and the partially circular profile of intermediate section 80 which embraces and captures coil spring 90 and button 88. As shown, spring 90 is captured by intermediate section 80 and is restrained to remain in that section of the cable pocket 34.

Figure 8:
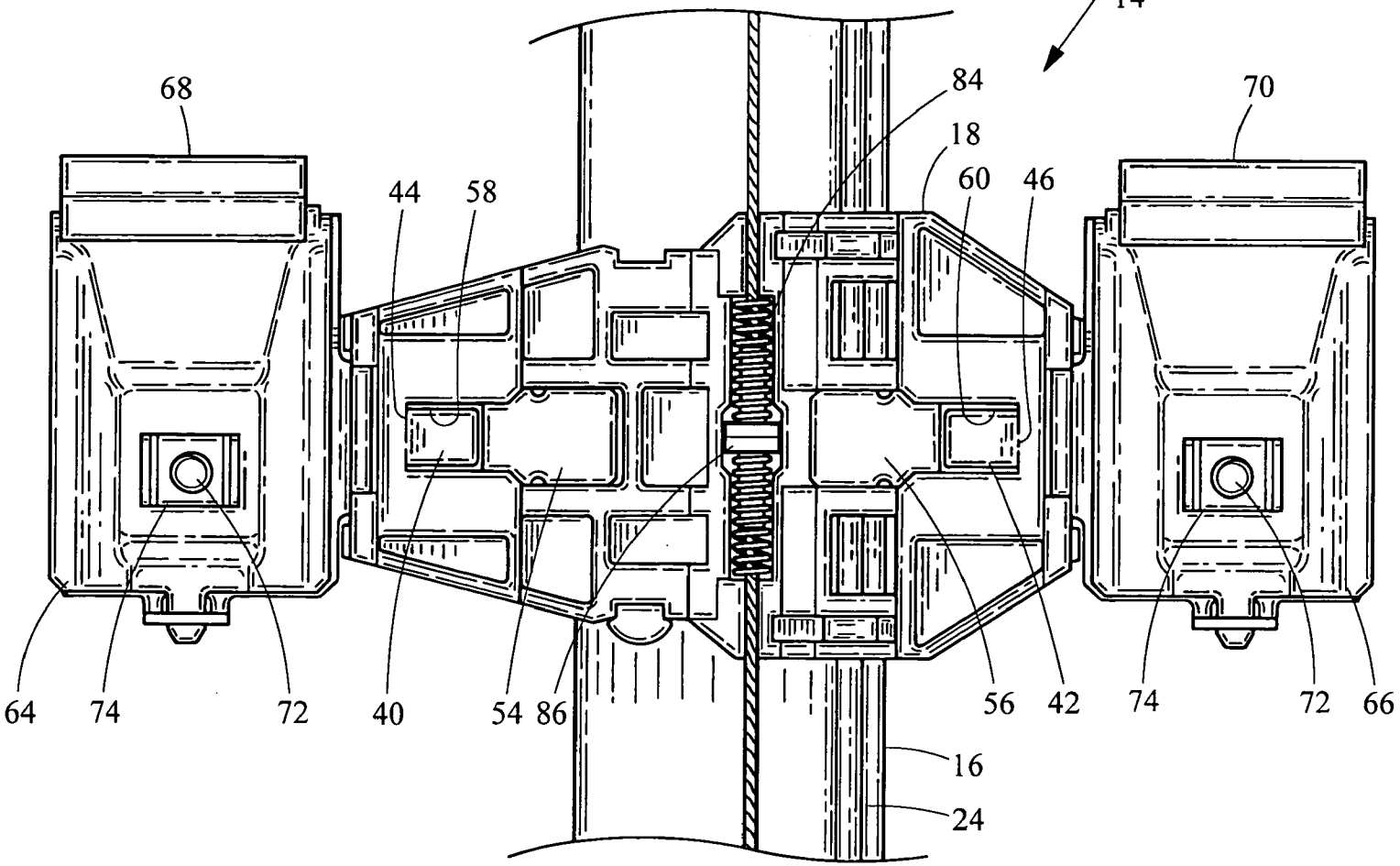
FIG. 8 is a side view of the window carrier assembly showing the cable ends inserted within the cable pocket with parts of the window carrier assembly cut-away to show the cable ends in elevation.

FIG. 5 shows cable end 84 ready to be installed within cable pocket 34. This is accomplished by loading the coil spring 90 and button 88 into center section 78. Thereafter, coil spring 90 relaxes and expands into intermediate section 80 as shown in FIG. 6. By pulling cable 90 taut, sufficient clearance is provided for the other cable end 86 to be inserted in a similar manner. FIG. 8 shows both of the cable ends 84 and 86 inserted. In actual use, cable 92 will be under sufficient tension such that buttons 88 are spread apart engaging the shoulder formed between center section 78 and intermediate sections 80 in their final resting position. The above-described configuration of the interaction between cable socket 76 and cable ends 84 and 86 provides a cost effective and reliable cable termination. This termination provides ease of assembly, and facilitates servicing if required.

FIGS. 9, 10, 11A, and 11B illustrate a second embodiment of a carrier assembly in accordance with the present invention designated by reference number 118. Features of this embodiment of a carrier assembly, which are identical to those previously described, are identified by like reference numbers. Carrier assembly 118 differs from the previously described embodiment of carrier assembly 18 in that center body 128 includes a pair of projecting locating tabs 94 and 96. In other respects, center body 128 is identical to center body 28 previously described. The function of locating tabs 94 and 96 is to further secure window clamps 30 and 32 when they are mounted to center body 128. Specifically, the desire is to reduce the pivotal motion of the window clamps 30 and 32 when they are mounted to the center body 128 and installed within the vehicle.

Figure 9:
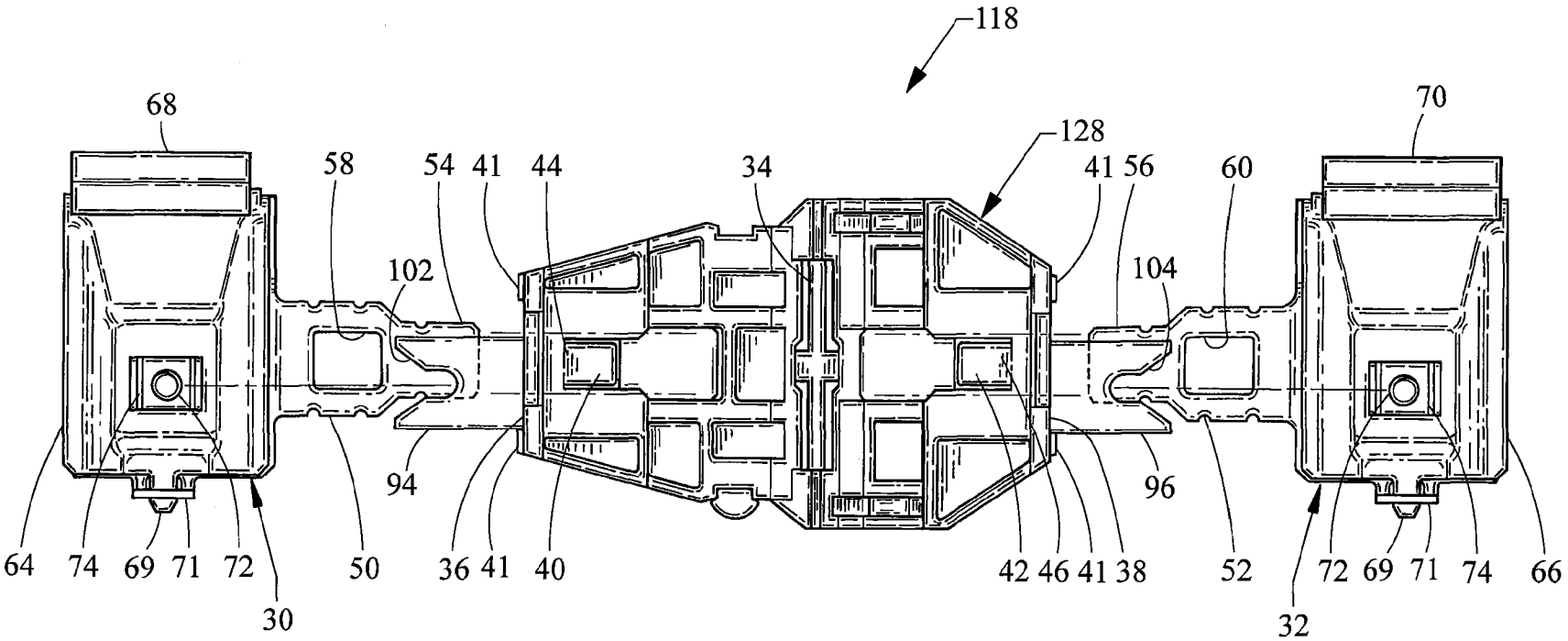
FIG. 9 is an exploded view of the window carrier assembly in accordance with a second embodiment of the present invention.

Locating tabs 94 each have an opening V-slot 102 and 104 which have a V-shaped guide opening which ends or bottoms out in a generally round center hole as illustrated in FIG. 9.

Figure 10:
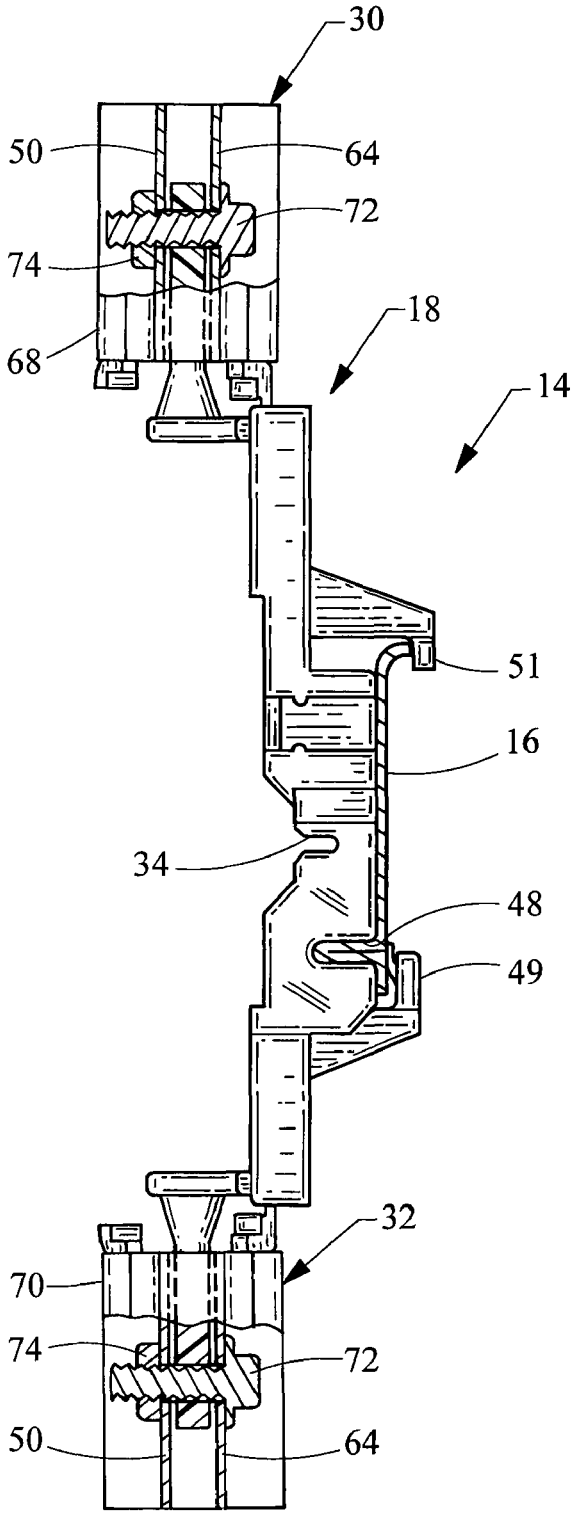
FIG. 10 is a cross-sectional view through the carrier assembly shown in FIG. 9.
Figure 11A:
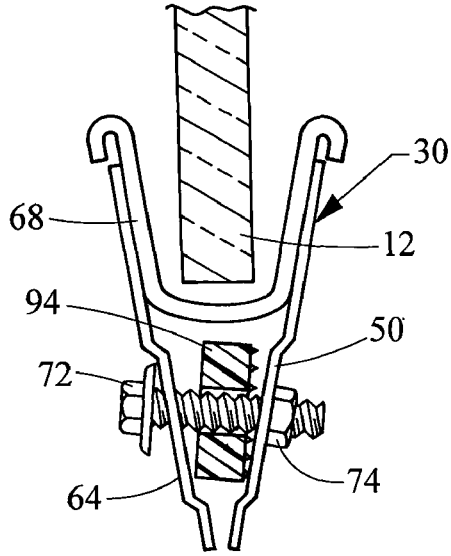
FIGS. 11A and 11B are cross-sectional views taken through the window clamp of the second embodiment of the present invention shown in unclamped and clamped positions respectively.
Figure 11B:
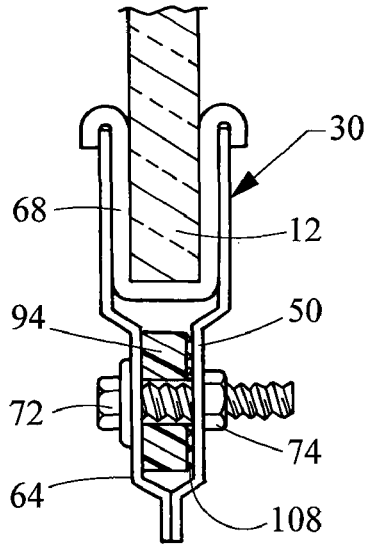

As best shown in FIG. 10, window clamps 30 and 32 are assembled to center body 128, locating tabs 94 and 96 become positioned between clamp bottom plate 50 and clamp top plate 64. During this assembly process, V-slots 102 and 104 locate threaded fasteners 72 within their narrowed center sections. This enhances the accuracy of location and provides secure positioning of window clamps 30 and 32 when they are assembled to center body 128. As best shown in FIGS. 11A and 11B, tightening of threaded fastener 72 cause window jaws 68 (and 70) to clamp against window 12. FIGS. 11A and 11B show clamp 30 which is identical to clamp 32.

It is desirable that this clamping action also places a compressive force on locating tabs 94 and 96 for purposes of enhancing the security of connection between the window clamps 30 and 32 with center body 128. While this is desired, it is also essential that clamps 30 and 32 securely clamp and structurally engage window 12. In order to achieve these objectives, locating tabs 94 and 96 need to be mechanically engaged with the bottom and top plates 50 and 64, respectively, through a range of clamped positions of these parts. One way of achieving this is to locate a series of flexible projections on one or both surfaces of locating tabs 94 and 96 which are illustrated as pointed projections 106 and are shown in FIG. 11A. Thus, when threaded fastener 72 is tightened, the top and bottom plates 50 and 64 are drawn together which structurally couples with locating tabs 94 and 96 while allowing the top and bottom plates to fully clamp against and engage with window 12. Other means of providing connection with locating tabs 94 and 96 could also be implemented. For example, a simple elastomeric pad could be placed between locating tabs 94 and 96 and surfaces of top plate 50 or bottom plate 64 (or both). Such an elastomeric pad 108 would provide compressibility over a range of compressions while not interfering of clamping of window 12. Once threaded fasteners 72 are tightened, window clamps 30 and 32 are securely positioned with little lost motion which could otherwise lead to buzz, squeak, or rattle (BSR) problems with the associated motor vehicle.

While the above description constitutes the preferred embodiment of the present invention, it will be appreciated that the invention is susceptible to modification, variation and change without departing from the proper scope and fair meaning of the accompanying claims.

The invention claimed is:

1. A carrier assembly for an automotive window regulator that uses at least one generally vertically extending guide channel and being driven by a cable to raise and lower a window panel between opened and closed positions, the carrier assembly comprising, a carrier body formed of a polymeric molded material and forming a channel for receiving the guide channel to allow the carrier body to move along the guide channel, and a cable mounting pocket formed to engage a pair of ends of the cable, and wherein the cable pocket forms a center section, a pair of intermediate sections extending from the center section and a pair of cable passages extending from the intermediate sections, the cross-sectional width of the sections decreasing from the center section to the intermediate sections and from the intermediate sections to the cable passages, each of the pair of ends of the cable having a button and a coil spring butting against the button, the cable ends mountable within the cable pocket such that the buttons are received by the center section and the coil springs are trapped within the intermediate sections between the buttons and the carrier body.

2. A carrier assembly for an automotive window regulator that uses at least one generally vertically extending guide channel, the carrier assembly being driven to raise and lower a window panel between opened and closed positions, the carrier assembly comprising, a carrier body formed of a polymeric molded material and forming a channel adapted to receive the guide channel to allow the carrier body to move along the guide channel, the carrier body further forming at least one laterally opening clamp mounting slot and at least one tab formed by the carrier body, and at least one window clamp formed of a metal material, the window clamp engaging a lower edge of the window panel and having a laterally extending mounting ear, the mounting ear received by the clamp mounting slot, the carrier body tab engaging the mounting ear to fasten the clamp to the carrier body;

wherein the clamp has a top and bottom plate and a threaded fastener to cause the clamp to compress against the window panel as the threaded fastener is tightened and the carrier body further having a laterally extending locating tab which is positioned between the top and bottom plates to be compressed between the plates when the fastener is tightened.

3. A carrier assembly according to claim 2 wherein the laterally extending locating tab forms a laterally opening V-shaped slot to receive the threaded fastener.

4. A carrier assembly according to claim 2 wherein the carrier assembly further comprises a second clamp mounting slot and a second tab formed by the carrier body and a second window clamp.

5. A carrier assembly according to claim 2 wherein the mounting ear forms an aperture which is engaged by the tab such that the tab extents into the aperture to interlock with the ear to mount the clamp to the carrier body.

6. A carrier assembly according to claim 4 wherein the carrier body forms one or more posts adjacent to the clamp mounting slots to engage the window clamps to stabilize the position of the window clamps when assembled with the carrier body.

7. A carrier assembly according to claim 4 wherein the carrier assembly is driven by a cable to move the window panel between the opened and closed positions.

8. A carrier assembly according to claim 7 wherein a cable pocket for engaging a pair of ends of the cable is formed in the carrier body.

9. A carrier assembly according to claim 8 wherein the cable pocket forms a center section, a pair of intermediate sections extending from the center section and a pair of cable passages extending from the intermediate sections, the cross-sectional width of the cable pocket in the center section being greater than the cross-sectional width of each of the intermediate sections and the cross-sectional width of each of the intermediate sections being greater than the cross-sectional width of each of the cable passages, the cable ends each having a button and a coil spring butting against the button, the cable ends mountable within the cable pocket such that the buttons are received by the center section, and the coil springs are restrained within the intermediate sections with the coil springs abutting against the buttons and the carrier body.

10. A carrier assembly for an automotive window regulator that uses at least one generally vertically extending guide channel and being driven by a cable to raise and lower a window panel between opened and closed positions, the carrier assembly comprising, a carrier body formed of a polymeric molded material and forming a channel for receiving the guide channel to allow the carrier body to move along the guide channel, the carrier body further forming a pair of laterally opening clamp mounting slots opening at laterally opposite sides of the carrier body, a pair of tabs integrally formed by the carrier body and a cable mounting pocket formed to engage a pair of ends of the cable, and a pair of window clamps formed of a metal material, the window clamps engaging a lower edge of the window panel and each having a laterally extending mounting ear each of the mounting ears including an aperture formed therein, the mounting ears received by the carrier body clamp mounting slots, the carrier body tabs engaging the clamp ears with the tabs engaging the apertures to fasten the clamps to the carrier body when the carrier assembly is assembled by attaching the window clamps to the carrier body;

wherein each of the clamps has a top and a bottom plate and a threaded fastener to cause the clamp to compress against the window panel as the threaded fastener is tightened;

wherein the carrier body further has laterally extending locating tabs which are positioned between a respective pair of the top and bottom plates to be compressed between the plates when the fasteners are tightened.

11. A carrier assembly according to claim 10 wherein each of the laterally extending locating tabs forms a laterally opening V-shaped slot to receive respective one of the threaded fasteners.

12. A carrier assembly according to claim 10 wherein the carrier body includes posts adjacent to the clamp mounting slots to engage the window clamps to stabilize the position of the window clamps when assembled with the carrier body.

13. A carrier assembly according to claim 10 wherein the cable pocket forms a center section, a pair of intermediate sections extending from the center section and a pair of cable passages extending from the intermediate sections, each end of the cable having a button and a coil spring butting against the button, the cable ends mountable within the cable pocket such that the buttons are received by the center section and the coil springs are trapped within the intermediate sections.

* * * * *

UNITED STATES PATENT AND TRADEMARK OFFICE

CERTIFICATE OF CORRECTION

PATENT NO. : 7,908,795 B2
APPLICATION NO. : 11/728618
DATED : March 22, 2011
INVENTOR(S) : Shigeki Arimoto It is certified that error appears in the above-identified patent and that said Letters Patent is hereby corrected as shown below:

In the Claims

In claim 5, column 6, line 13, after “tab”, delete “extents” and insert --extends--.

In claim 11, column 7, line 5, after “receive”, insert --a--.

Signed and Sealed this
Thirty-first Day of May, 2011

David J. Kappos

David J. Kappos
*Director of the United States Patent and Trademark Office*